United States Patent [19]

Hashimoto et al.

[11] 4,181,228

[45] Jan. 1, 1980

[54] APPARATUS FOR CONVEYING COPS AND BOBBINS FOR DIRECTLY CONNECTING RING FRAME WITH WINDER

[75] Inventors: Kiyozi Hashimoto; Tsuyoshi Shimatani; Takemi Yamamoto; Ryoichi Morimoto; Ikuo Ueda, all of Okayama, Japan

[73] Assignee: Kuraray Co., Ltd., Okayama, Japan

[21] Appl. No.: 896,334

[22] Filed: Apr. 14, 1978

[30] Foreign Application Priority Data

Apr. 15, 1977 [JP] Japan ..... 52/43739

[51] Int. Cl.[2] ..... B07C 5/00

[52] U.S. Cl. ..... 209/552; 209/927; 198/651

[58] Field of Search ..... 209/927, 552; 198/651

[56] References Cited

U.S. PATENT DOCUMENTS

| | | | |
|---|---|---|---|
| 3,024,887 | 3/1962 | Ingham, Jr. | 198/651 |
| 3,531,016 | 9/1970 | Pray | 198/651 |
| 3,698,536 | 10/1972 | Pray et al. | 198/651 |
| 3,788,054 | 1/1974 | Haussmann | 198/651 |
| 3,955,496 | 5/1976 | Urban | 198/651 |

*Primary Examiner*—Allen N. Knowles

*Attorney, Agent, or Firm*—Oblon, Fisher, Spivak, McClelland & Maier

[57] ABSTRACT

This invention relates to an apparatus for conveying cops and bobbins for directly connecting a ring frame with a winder wherein one operation to feed those cops which are doffed onto the transport-bands on both the right and left sides of the ring frame to the subsequent process from one end of each of the transport-bands and the other operation to receive bobbins needed for the next doffing onto the transport-band are together simultaneously performed, with these two simultaneous operations being repeated. This invention has no provision of a random stock zone and the substantial function of bobbin stock is given to the transport-band, and the bobbin returned from the winder is adjusted in alignment thereof by the bobbin aligning device and conveyed by the bobbin stock conveyor and dropped onto the transport-band.

7 Claims, 30 Drawing Figures

APPARATUS FOR CONVEYING COPS AND BOBBINS FOR DIRECTLY CONNECTING RING FRAME WITH WINDER

BACKGROUND OF THE INVENTION

1. Field of the Invention

This invention relates to an apparatus for conveying cops and bobbins for directly connecting a ring frame with a winder.

2. Description of the Prior Art

An overall arrangement of an apparatus, as an example of the prior art, is shown in FIG. 26, wherein transport-band line 201, consisting of an endless belt horizontally extending along and throughout the right (R) and left (L) sides of a ring frame 202 and slightly apart from the out-end (OE) thereof, is driven continuously or intermittently in one direction. A winder 207 is fed with cops through a cop feeder 204 and a cop conveyor 206, and the bobbins released from the winder 207 are conveyed to a bobbin feeder 205 through an appropriate conveying means. The pegs 203 are fed with bobbins from the bobbin feeder 205. (The above will be hereinafter called the "conventional system (1)")

The relation between the production of the ring frame (the number of cops: 2n is assumed) and the cop-processing time in the winder in this system is diagrammatically shown in FIG. 29. When the (Nc) of cops to be fed or that of bobbins to be received is taken in the ordinate and time (Ts) in the abscissa, a point C denotes the time when doffing at the ring frame 202 is completed and the transport-band starts moving. Feeding of cops is not performed before a point D that denotes the end of the time spanning from 0 to $T_A$, that is, until when a cop doffed at the spindle position $B_2$ at the OE part on the L-side of ring frame 202 in FIG. 26 is conveyed to the cop feeding point $C_2$, irrespective of the movement of the transport-band 201. Cop feeding on the L-side is started at a point D and completed at E after the lapse of time Tc, that is, when a cop doffed at $A_2$ at the GE part on the L-side reaches $C_2$. Also, cop feeding is not performed during the time E to F that corresponds to the end of the lapse of time $T_D$, that is, when a cop doffed at the spindle position $A_2$ at the GE part on the L-side passes $C_2$, as well as when a cop at $D_2$ at the GE part on the R-side comes to $C_2$, irrespective of the movement of the transport-band 201. Cop feeding on the R-side is again started at F and completed at G after the lapse of time $T_G$, that is, when a cop at $E_2$ at the OE part on the R-side reaches $C_2$, thus the entire performance of cop feeding being completed. A point H after the lapse of time $T_B$ represents the time when bobbin receiving by the transport-band 201 is started, after a peg at $B_2$ at the time of starting reaches $F_2$, the position of cop feeder 205, following performance of cop feeding at $C_2$. Bobbin receiving on the R-side is started as late as required for the movement of the transport-band 201 from $B_2$ to $F_2$ through $C_2$, corresponding to a time difference $T_B-T_A$, and completed at I after the lapse to time $T_E$, that on the L-side being started at J after $T_F$ and completed at K after $T_H$. Further, a length of time corresponding to $T_Y-T_H$ is required for the movement of the transport-band to a point L, which corresponds to the end of the lapse of time $T_Y$ and also to the next starting point. In this way, cop feeding according to this system is performed in such order as shown by the continuous line CDEFG and bobbin receiving as shown by chain line HIJKL. A point C represents the time when doffing is completed and the start of movement of the transport-band is made possible. Assuming that $T_Y$ is the time limit for completion of preparation of the next doffing in the case of the ring frame 202, the line to represent the minimum feed of cops is shown by the continuous line CDEFG. In other words, the required lowest limit of yarn winding capability of the winder is $2n/[(T_G-T_D)+(T_C-T_A)]$ (cops/hour), when a stock zone for cops is not provided between the ring frame 202 and the winder 207. When the required winding capability of the winder is lowered as far as possible, the winding rate diagram of the winder is drawn by the alternate long and two short dashes line DL where the winding capability is $2n/(T_Y-T_A)$ (cops/hour). However, for preventing a decrease in the operational efficiency of the ring frame 202, it is necessary to complete cop feeding at a point G, that is, not later than the end of the lapse of time $T_G$. A perpendicular length to a point $S_A$, where the alternate long and two short dashes line DL intersects a perpendicular extending from G, represents the number of cops to be consumed by the winder within the lapse of time $T_G$, and the remainder NA represents the smallest number of cops required to be kept as a stock. In addition, assuming $H_2$ and $H'_2$ as points of intersection where the straight lines DE and DL intersect a perpendicular from $T_B$, respectively, and $N_2$ and $N'_2$ as the numbers of cops to be fed corresponding to $H_2$ and $H'_2$, respectively, the number of bobbins released within the time $T_B-T_A$ is required to be kept as a stock for a while, and the smallest number of bobbins to be stocked in $N_2$ when the stock zone for cops is not provided and $N'_2$ when the zone is provided.

A control method over operation of the transport-band according to this system will now be described. As is apparent from FIG. 29, during the time from the end of doffing to $T_A$, only the belt moves and neither cop feeding or bobbin receiving is performed. Bobbin receiving is not performed between $T_A$ and $T_B$ while cop feeding is done. Cop feeding and bobbin receiving are both performed between $T_B$ and $T_C$; between $T_c$ and $T_D$ there is bobbin receiving only and no cop feeding; between $T_D$ and $T_E$, both bobbin receiving and cop feeding are performed; between $T_E$ and $T_F$, there is cop feeding only and no bobbin receiving; between $T_F$ and $T_G$, there is both bobbin receiving and cop feeding; between $T_G$ and $T_H$, there is bobbin receiving only and no cop feeding; and between $T_H$ and $T_Y$, there is no cop feeding and no bobbin receiving while the belt moves. Thus, one cycle of operation is completed and preparation for the next doffing is made, in which a greatly complexed control method is required.

Incidentally, the time between $T_Y$ and $T_Z$ in FIG. 29 shows a duration in which the movement of the transport-band is interrupted by doffing at the ring frame (Similarly in FIGS. 30 and 28, as will be described later).

FIG. 27 is a plan view showing an overall arrangement of an apparatus wherein a transport-band 301 consisting of an endless belt and extending along R- and L-sides of the ring frame 302, is continuously or intermittently moved around in reciprocation, performing cop feeding for the winder 307 on going through the chute 304 and cop conveyor 306, and conveying bobbins released from the winder 307 through an appropriate conveying means to the bobbin feeder 305 in addition to applying the bobbins to the pegs 303 from the bobbin feeder. (The above will hereinafter be called the "conventionally system (2)"). FIG. 30 is a diagram showing the relation between the production of the ring frame (No. of cops, 2n) and the cop-processing time in the winder, wherein the number (NC) of cops fed or that of bobbins received is taken on the ordinate and time (TS) on the abscissa, the same as in FIG. 29. A point M represents the time when doffing at the ring frame 302 is completed and the transport-band 301 starts moving, and cop feeding is not performed before a point N representing the end of the lapse of time $T_I$, that is, until when a cop doffed at the spindle position $F_3$ at the OE part on the R-side of the ring frame in FIG. 27 reaches the cop feeding position $H_3$ on the R-side, irrespective of the movement of the transport-band 301. When cop feeding is started at a point N and completed at a point P after the lapse of time $T_J$ (the time when a cop at the spindle position $E_3$ at the GE part on the R-side reaches a point $H_3$), cop feeding on the L-side is again started upon re-actuation of the transport-band on the L-side, which has already conveyed a cop doffed at the spindle position $E_3$ at the OE part on the L-side earlier than the end of the lapse of time $T_J$ to the cop feeding point $D_3$, and is completed at a point Q after the lapse of time $T_L$ (the time when a cop at the spindle position $A_3$ at the GE part on the R-side reaches a pont $D_3$). A point R after the lapse of time $T_J$ represents the time when cop feeding is completed and the transport-band 301 starts moving inversely, and bobbin receiving is not performed during the time from R to S, i.e., the time during which a peg positioned at $E_3$ comes from $H_3$ to the bobbin receiving position $G_3$, irrespective of the movement of the transport-band 301 on the R-side. Bobbin receiving is started at a point S and completed at U after the lapse of time $T_M$, i.e., the time during which a peg positioned at $F_3$ at the time of starting in FIG. 27 reaches a point $G_3$, however, if the peg is further moved to the initial position (a point $F_3$) without receiving a bobbin, the transport-band 301 is made ready for the doffing position, the state of which corresponds to a point V. Similarly, the state of bobbin receiving by the transport-band 301 on the L-side is shown by the dotted line TU'WY. In this case, the points U and U' do not always agree with each other in such manner as shown in the drawing. A point M represents the time when doffing is completed and the transport-band is made able to start moving, and a line representing the lowest allowable limit for bobbin removal is drawn as MNPQ when assuming a point Y as the time limit to the completion of preparation for the next doffing in consideration of condition on the part of the ring frame 302. In other words, the required lowest limit of winding capability of the winder is $2n/(T_L-T_I)$ (cops/hour) so far as when a stock zone is not provided between the ring frame 302 and the winder. When the required winding capability of the winder is lowered as far as possible, the winding rate diagram of the winder is drawn by the alternate long and two short dashes line NY, where the required winding capability is $2n/(T_Y-T_I)$ (cops/-hour). However, for preventing a decrease in the operational efficiency of the ring frame 302, it is necessary to complete cop feeding at a point Q, that is, not later than the end of the lapse of time $T_L$. A perpendicular length to a point $S_B$, where the alternate long and two short dashes line NY intersects a perpendicular extending from Q, represents the number of cops to be consumed by the winder within the lapse of time $T_L$, and the remainder $N_B$ represents the smallest number of cops required to be kept as a stock. In addition, assuming $S_3$ and $S'_3$ as points pf intersection where the straight lines NQ and NY intersect a perpendicular from $T_K$, respectively, and $N_3$ and $N'_3$ as the numbers of cops to be fed corresponding to $S_3$ and $S'_3$, respectively, the number of bobbins released within the time $T_K-T_I$ is required to be kept as a stock for a while, and the smallest number of bobbins to be stocked in $N_3$ when a stock zone for cops is not provided and $N'_3$ when the zone is provided.

A control method over operation of the transport-band according to this system will now be described. As is apparent from FIG. 30, during the time from the end of doffing to $T_I$, only the belts on the R- and L-sides move and neither cop feeding or bobbin receiving are performed; from $T_I$ to $T_J$, there is cop feeding only on the R-side; from $T_J$ to $T_K$, there is cop feeding on the L-side and inverse movement of the transport-band on the R-side; between $T_K$ and $T_L$, cop feeding on the L-side and bobbin receiving on the R-side are performed; from $T_L$ to $T_M$, there is bobbin receiving on the R-side and inverse movement of the transport-band; between $T_M$ and $T_N$, there is inverse movement of the band only; and thus a greatly complexed method is required, the same as in the conventional system (1).

In both cases, in the conventional systems (1) and (2), when a reduction in the number of winders is intended, depending on the increase in winding efficiency, provision of stock zones for cops and bobbins is required, leading to increased frequency of cop feeding and bobbin receiving operations, requiring provision of not only stock equipment but also an increase in the number of equipments for feeding, receiving, and aligning of cops and bobbins in addition to control devices therefor, and inviting disorder in keeping cops and troubles in the machines concerned.

SUMMARY OF THE INVENTION

The object of this invention is to provide an all-out solution to a number of technical problems in the prior art, as set forth above, by employing a quite simple system and apparatus, and to obtain a great reduction in costs of equipments and operation.

This object and others are achieved according to the present invention by employing a quite simple but epochal system and apparatus wherein one operation to feed those cops which are doffed onto the transport-bands on both the R-and L-sides of the ring frame to the subsequent process from one end of each of the transport-bands and the other operation to receive bobbins needed for the next doffing onto the transport-band are together simultaneously performed, these two simultaneous operations being repeated.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein.

DETAILED DESCRIPTION OF THE PREFERRED EMBODIMENTS

Figure 1:
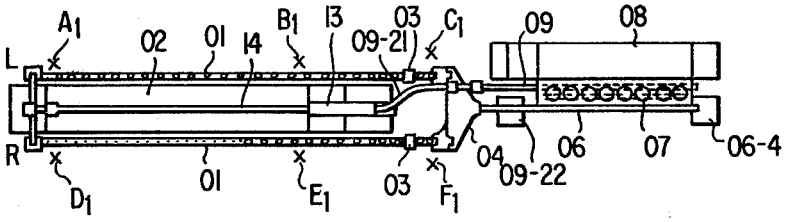
FIG. 1 is a plan view showing one embodiment of the present invention applied to a ring frame equipped with spindles on both sides thereof.
Figure 2:
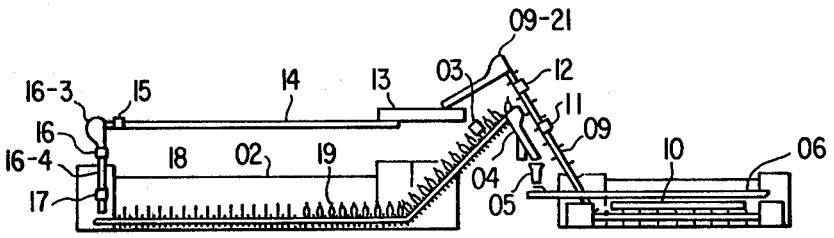
FIG. 2 is an elevation view of the embodiment shown in FIG. 1.
Figure 3:
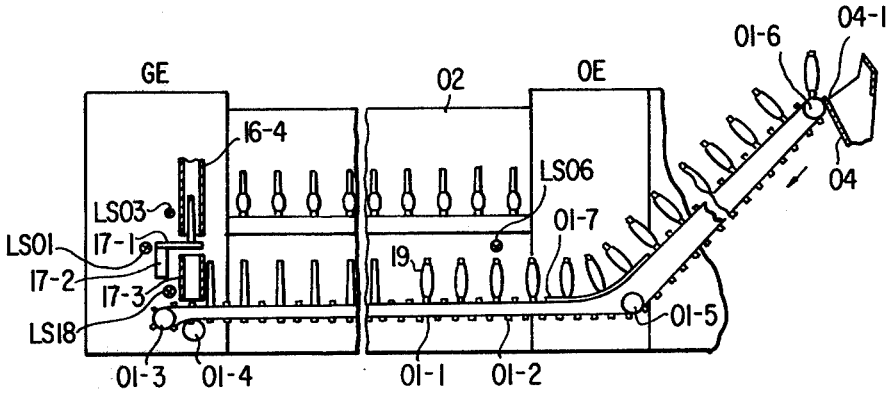
FIG. 3 is a partially enlarged view of FIG. 2.

Referring now to the drawings, and more particularly to FIGS. 1–3, along the R- and L-sides of the ring frame 02, the transport-bands 01 are provided for receiving bobbins 18 and feeding of cops 19 doffed from the ring frame 02 to the subsequent process. The transport-band 01, comprising a flat belt 01-1 on which the pegs 01-2 are implanted throughout the outer surface thereof at pitches equal to a half of the spindle pitch on the ring frame 02, a driving pulley 01-3, idlers 01-4, 01-5, a return pulley 01-6, and a belt guide 01-7, rides on the OE side of the ring frame and extends to the cop chute 04 for feeding cops doffed from the ring frame 02 to the subsequent process.

The cops 19 are conveyed to the front of the chute 04 by the intermittent one-way circuital movement of the transport-band 01, released by a cop-releasing means, such as a pawl guide 04-1, and sent to the cop feeder 05 through the cop chute 04, which is used jointly by cops sent from both the R-and L-sides.

A pre-treatment means 03 for the yarn end is provided at the middle position between the spindle position at the extreme OE part of the ring frame 02 and the top position of the transport-band 01, for making it easy to catch the end of yarn would into cop 19 in the subsequent process. However, this means 03 for pre-treatment of the yarn end is not always indispensable and is optional according to the shape of cop.

Figure 4:
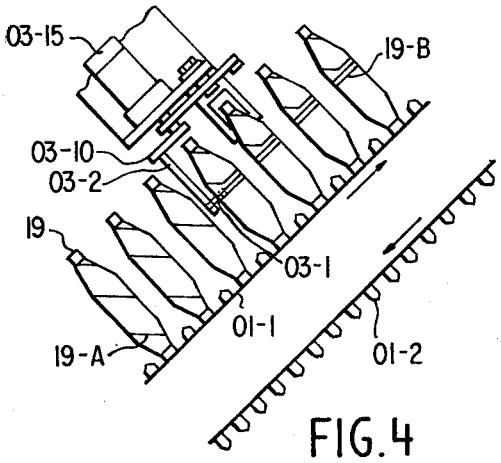
FIG. 4 is an enlarged view of the yarn end pretreatment means of the invention.

FIG. 4 is an enlarged view of the yarn and pre-treatment means, including an adjacent part thereof, wherein the revolution of the driving device 03-15 fixed to the frame 03-16 is tramsitted to a long axis 03-2 through the eccentric arm 03-10 and the long axis 03-2 rotates around the cop 19. A pawl 03-1 is mounted at the tip of the long axis 03-2, and this tip is energized to be directed toward the axis of cop. Therefore, with the revolution of the long axis 03-2, the pawl 03-1 thereof catches the end of the yarn on the surface of the cop and changes the position of the yarn end of the cop as shown at 19-A into that as shown at 19-B.

A sensor for detecting irregular shaped cops is provided at the entrance of the cop chute, the normal cops and the irregular ones being classified through the revolutions of a gate in the chute and adapted to proceed in different courses respectively, with the irregular cops being excluded from the system when found. The normal cops 19 passing the cop chute 04 are delivered into the cop feeder 05, as shown in FIG. 2, subjected to passing-through operation in which the yarn end is passed through the inside of bobbins, as shown in FIGS. 5 or 6, retained for a while as they are, and then fed to the cop conveyor 06 according to the cop-requiring signal.

Figure 5:
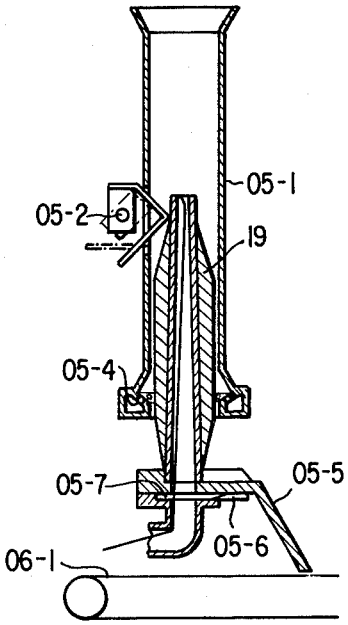
FIG. 5 is a sectional view of a cop feeder, forming part of the present invention, and shown in a vertical position.
Figure 6:
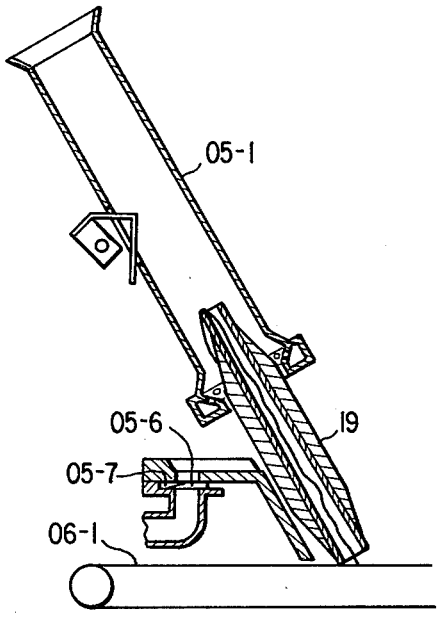
FIG. 6 is a sectional view of the cop feeder shown in FIG. 5, but shown in an inclined position.
Figure 7:
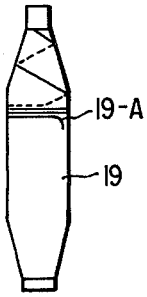
FIGS. 7 and 8 are diagramatical views of a cop, the latter showing the yarn ends thereof being upwardly blown by compressed air spouting from an opening in the bobbin.
Figure 8:
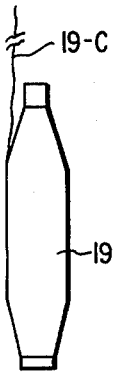
Figure 9:
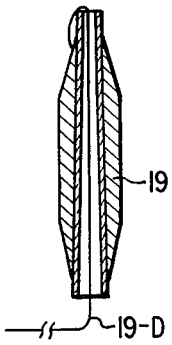
FIGS. 9 and 10 are sectional views of a hollow bobbin, showing that the yarn ends blown upward in FIG. 8 are sucked into the hollow thereof when a suction opening is opened.
Figure 10:
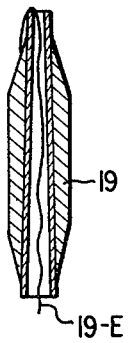

The cop feeder 05 comprises a cylindrical body 05-1 slightly larger in diameter than the cop, as shown in the sectional views in FIGS. 5 or 6, a cop receiver 05-5 positioned under the cylindrical body 05-1 and receiving the cop dropped through the cylindrical body, a yarn cutter 05-6 under the cop receiver 05-5, and a yarn suction device. The cylindrical body 05-1 is rotatably supported by the axis 05-2 so as to be capable of changing the posture thereof from vertical to inclined and is provided with a spouting opening from which compressed air is blown upwardly toward the inside thereof. A suction opening 05-7, smaller in diameter than the bottom end of bobbin, is provided at the position onto which the cop is dropped and communicates with the suction device interposing the yarn cutting means therebetween. That is to say, the yarn end 19-A of the cop wound in the shape as shown in FIG. 7 is upwardly blown from the compressed air spouting opening 05-4 after a preset time following sensing of the passing of normal cop through the cop chute 04. When blowing-out of the compressed air is stopped after a preset time and, at the same time, the suction opening 05-7 communicating with the suction device is opened, the yarn end 19-C blown upward is sucked into the hollow of the bobbin, as shown in FIG. 10. In this case, the cutter 05-6 serves as a shutter for the suction opening 05-7, also cutting the yarn under the process of suction and closing the entrance of the suction opening 05-7.

The cop subjected to a passing-through operation is kept as it is for a while and then fed to the cop conveyor 06 with the action of the cylindrical body 05-1.

Figure 11:
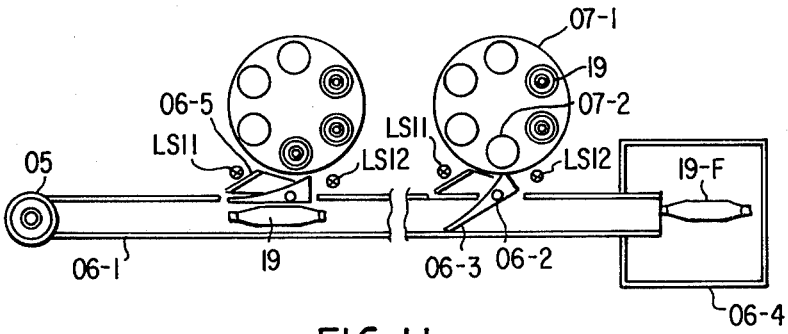
FIG. 11 is an enlarged plan view of the magazine and adjacent parts thereof, forming another part of this invention.

The cop conveyor 06 comprises a conveyor belt 06-1 longitudinally arranged from the lower side of the cop feeder 05 to the front side of the winder 08 and extending to the other extreme end of the winder. Magazine gates 06-3, adated to turn with a fixed angle around the support axis 06-2, as shown in FIG. 11, are provided on the intermediate parts of conveyor belt 06-1, corresponding to individual winders 08-1.

The cop 19 fed to the conveyor belt 06-1 passes by where the magazine gate is closed, and is thrown through the chute 06-5 into the magazine 07 where the gate is open. The magazine 07 is provided with a certain number of pockets 07-2 in the main body 07-1 thereof and the cop 19 is thrown into magazine pockets 07-2. When the main body 07-1 of the magazine is turned at a certain angle, according to the individual winder, the turning angle thereof is sensed by the sensor $LS_{12}$ and, as a result, the magazine gate 06-3 corresponding to the winder is made open. Also, when a turn of the main body 07-1 of the magazine is sensed, the cop feeder 05 is actuated and the cops 19 are transferred to the cop conveyor 06 and thrown into the magazine 07 through the magazine gate 06-3 and chute 06-5. The magazine gate 06-3 is adapted to be closed upon sensing the cops passing through chute 06-5 by means of the sensor $LS_{11}$. Since the magazine gate 06-3 remains closed when the cops 19 are fed to the cop conveyor 06, according to the signal from the memory, which will be described later, of the ring frame, a device is provided so that cops overflowing from the cop conveyor 06 are excluded from the system and stored as surplus cops 19-F in the surplus cop stock box 06-4 provided on the end of the conveyor 06.

A description will now be made about operation control over the cop feeder 05 and exclusion of surplus cops from the system.

Feeding of all cops 19 on the transport band 01 to the subsequent process must be completed, in the usual case, within a fixed time prior to the start of a doffing operation following the completion of yarn winding on the ring frame. However, when there occurs a trouble in any part of the winder 08 before the completion of cop feeding, complete feeding of all cops on the transport-band within a fixed time is impossible if the cop feeding operation is suspended with the stoppage of the cop feeder 05 and the transport-band 01 until the trouble is removed and machine function is restored. In such case, the doffing operation at the ring frame within a fixed time onto the transport-band is impossible and the ring frame must be stopped until doffing is made possible (all cops on the transport-band are sent out), causing a reduction of production capacity of the ring frame.

For eliminating such inconvenience, in the system according to this invention, the cop feeder 05 is actuated to deliver forward cops on the transport-band not only when the cop-demanding signal comes from the winder side but also when no signal comes, due to any trouble on the winder side. In the latter case, the cops fed from the cop feeder 05 to the conveyor 06 are excluded from the system as surplus ones and are stored as a stock. In conclusion, control over the cop feeder in this system is performed in such a way as providing the counting means, which will be defined in the following paragraph, for the ring frame and the winder and actuating each cop feeder 05 when the computation results obtained by the ring frame counter and winder counter are plus (+).

The ring frame counting means is defined as a means for computing the number of two kinds of signals, i.e., one which is emitted once per value (time), derived from dividing the length of time of yarn winding to form a cop on the ring frame by the number of cops to be fed to the subsequent process within the time of one cycle, and assumed as plus (+), and the other one which is emitted once per pitch in the movement of the transport-band and assumed as minus (−). The winder counter means is defined as a means for computing the number of two kinds of signals, i.e., one which is emitted one per occasion on which the magazine gate is made open and assumed as plus (+), the other one which is emitted once per actuation of the cop feeder and assumed as minus (−). In other words, the cop feeder 05 is actuated in response to the cop-demanding signal from either the ring frame counter or the winder counter, and the cops to be fed to the conveyor 06 for the subsequent process, some cops corresponding to the ring frame counter and others to the winder counter, are automatically classified according to the final location thereof. This classifying mechanism associated with these two counting means is very effective.

The bobbins 18 released from the winder 08 are transferred to the bobbin conveyor 09, as shown in FIGS. 1 and 2.

The bobbin conveyor unit 09, whose bobbin guiding path is partly horizontal and partly slanting, comprises a pair of supporting parts which mount the bobbins laid on the surfaces of the left and the right side-plates thereof and form a guiding path in which bobbins are conveyed in the longitudinal direction of themselves, docks which are provided upwardly and protrusively in the space between such bobbin supporting parts for pushing the rear end of bobbins supported above the guiding path, and a conveying belt to move docks along this space. Further, with advancing from the horizontal conveying part to the slanting one, the areas of the bobbin supporting parts are reduced, and, at the slanting part, the bobbin supporting parts are constructed so small as to support only one piece of bobbin, whose longitudinal axis entirely agrees with the center of the bobbin guiding path, and to exclude those bobbins which partially deviate from the guiding path, permitting the bobbins excluded and slipped down the guide plate to ride on the guiding path and to rise again with lifting by the dock.

An additional installation of a bobbin feeding conveyor 10 on the horizontally running part of the bobbin conveyor 09 for compensating a shortage of bobbins is desirable.

Figure 12:
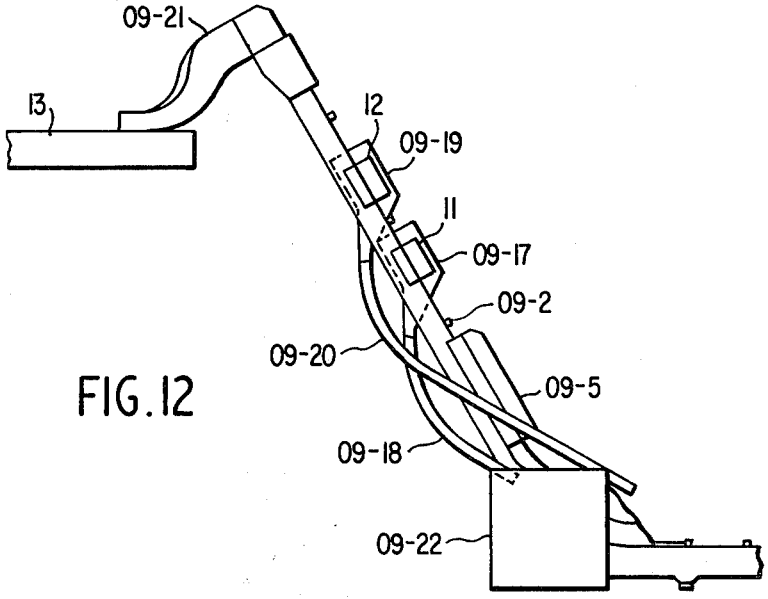
FIG. 12 is a side view showing a classifying means for bobbins at the part where the bobbin conveyor begins an uprising.

FIG. 12 is a side view showing a classifying means for bobbins at the part where the bobbin conveyor begins an uprising. As seen in this drawing, a bobbin release device 11 for detecting such bobbins as containing remaining yarn and removing these bobbins from the conveyor line is provided at the uprising point of the bobbin conveyor, and the bobbins with remaining yarn are adapted to be delivered through the chute 09-17, 09-18 and stored in the box 09-22 for the remaining yarn containing bobbins. It is desirable to provide a surplus bobbin returning device 12 having the same mechanism as that of the remaining-yarn-containing-bobbin releasing device in the rear of the remaining-yarn-containing-bobbin releasing device, in order to return surplus bobbins to the horizontal part of bobbin conveyor 09 or to store the same in the bobbin box through the chute 09-19, 09-20.

The bobbins 18 without remaining yarn that have passed the aforesaid devices are upwardly carried by the bobbin conveyor 09 and thrown into the bobbin aligning device 13 through the chute 09-21 provided at the top position.

Figure 13:
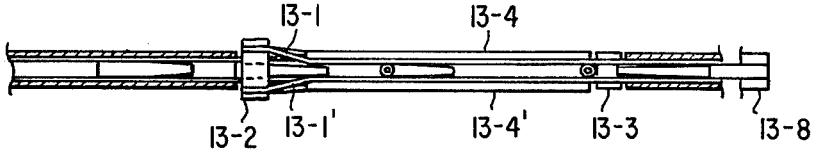
FIG. 13 is a plan view of a bobbin aligning device of the present invention.
Figure 14:
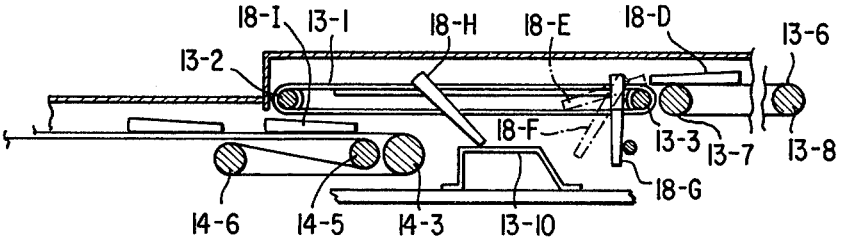
FIG. 14 is a side view of the bobbin aligning device shown in FIG. 13.

The bobbin aligning device, shown in FIGS. 13 and 14, is composed of two lines of round belts 13-1 and 13-1' applied on the driving pulley 13-2 and the returning pulley 13-3 in parallel with each other and adapted to run in one direction, a distance between two lines of belts 13-1 and 13-1' being kept at a certain length so as to permit the end of bobbin of small diameter to pass through therebetween while preventing that of large diameter from doing so, and a distance at the forward position in the running direction of belt being widened to drop the bobbins that have been conveyed thereto toward the conveyor 14 positioned under the round belts 13-1 and 13-1'. The bobbin thrown through the chute 09-21 and having different direction at the ends thereof is received at first by the sub-conveyor 13-6 extended between the driving pulley 13-7 and the return pulley 13-8 and then transferred to round belts 13-1 and 13-1'. The distance between 13-1 and 13-1' is controlled by the control guide 13-4, 13-4', and the bobbin 18 transferred thereon proceeds, while retained by the round belts 13-1, 13-1', in a posture that the large end is up and the small end down. Then the bobbin proceeds while touching the anti-swing guide 13-10 provided for preventing the swing motion of the small end of the bobbin just before the conveyor 14 for the subsequent process and the small end rides on the conveyor 14 in the immediate rear of guide 13-10. With the advance of the bobbin in such a state as above, the large end of the bobbin reaches the forward positions of the belts 13-1, 13-1', where the distance between these belts is larger than the diameter of the large end of the bobbin, and, therefore, drops onto the conveyor 14, thus being fed always ahead of the other parts in the moving direction.

Figure 15:
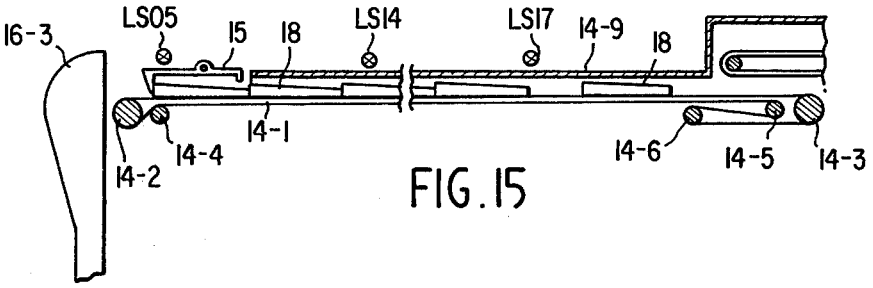
FIG. 15 is a side view illustrating a specific construction of the bobbin stock conveyor shown in FIG. 1.
Figure 16:
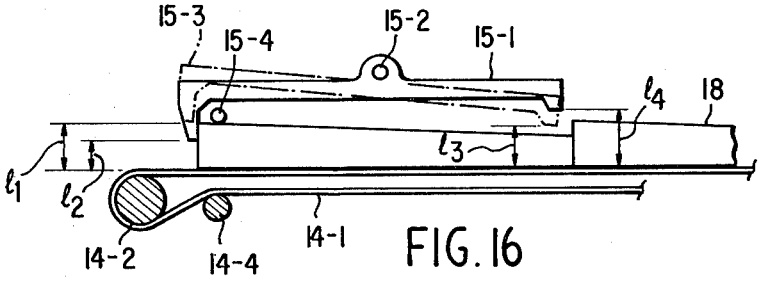
FIG. 16 is an enlarged view of the bobbin stopper on the front end of the conveyor shown in FIG. 15.
Figure 17:
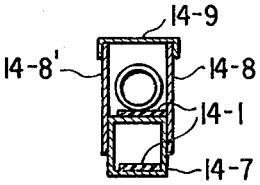
FIG. 17 is a sectional view of the intermediate portion of the conveyor shown in FIG. 15.

The bobbin stock conveyor comprises, as shown in FIGS. 15-17, a flat belt 14-1, a driving pulley 14-2, a return pulley 14-3, idlers 14-4, 14-5, a tension pulley 14-6, a belt receiver 14-7, side covers 14-8, 14-8', and a top cover 14-9, and provided with bobbin stopper 15, which are all provided on the top of the ring frame, as shown in FIG. 2. The bobbins sent from the bobbin aligning device 13 and transferred onto the conveying flat belt 14-1 in a stage that the large end of bobbin is ahead of other portions in the moving direction are conveyed in alignment with each other, and, in the usual case, a bobbin 18 lying mostly ahead of the others is retained by bobbin stopper 15 and the other following ones are kept as a stock. Even when the bobbins 18 are kept motionless and in stock, the flat belt 14-1 continues to run between the belt receiver 14-7 and bobbins 18, causing a slip between itself and bobbins 18 and exhibiting functions of both conveyance and stocking of bobbins. Bobbin stopper 15, in the shape of a staple, is adapted to be capable of turning at a certain fixed angle around the supporting axis 15-2 and put in positions as shown by the continuous line 15-1 in FIG. 16 when the stopper is kept in the closed state and as shown by the alternate long and two short dashes line 15-3 when the stopper is in the open state. For preventing the end of bobbin stopper 15 from lifting up the end of bobbin, an anti-lifting bar 15-4 is provided, as shown in FIG. 16.

Assuming da and db as the large diameter of bobbin and the small diameter, respectively, $l_2$ and $l_4$ as the distances between the lower end of the front toe of the bobbin stopper 15, in the closed state 15-1, and the flat belt 14-1, and between the rear toe and the belt 14-1, respectively, $l_1$ and $l_3$ as those in the open state 15-3 and $l_x$ and $l_y$ as those in the state of turning of the bobbin stopper, the following relations can be established:

$$db < l_3 < da < l_4$$

$$l_2 < da < l_1$$

and the size of the bobbin stopper is determined so as to satisfy the following conditions:

$$l_y < da \text{ when } l_x = da$$

$$l_x < da \text{ when } l_y = da$$

That is to say, the bobbins 18 retained are released and thrown into the chute 16-3 when $l_x = da$. Since $l_y$ at the rear toe becomes smaller than da at the moment when a retained bobbin 18 is released, the subsequent bobbin 18 can surely be stopped by the rear toe, regardless of the speed of the flat belt 14-1 and turning speed of bobbin stopper 15, being given full attention so that simultaneous feeding of two pieces of bobbins can be prevented under any condition.

As shown in FIG. 3, a bobbin feeding device, comprising a chute 16-4, a bobbin receiver 17-1, a bobbin receiver turning axis 17-2, and a bobbin guide 17-3, is provided apart from the center of the spindle located at the GE side end of the transport-band 01 by a distance equal to $(N+\frac{1}{2})xL$, (where N is either zero(0) or a positive integer, L is the spindle pitch of the ring frame). In the usual case, a piece of bobbin 18 is stocked in bobbin receiver 17-1, insofar as the closed state of the bobbin receiver 17-1 is ascertained by the sensor LS 01, and presence of bobbin therein is ascertained by the sensor LS 03; the bobbin receiver 17-1 is put in an open state when the transport-band 01 is ascertained to be under a halt at a fixed position, causing bobbin 18 to drop through the bobbin guide 17-3 and be received by the peg 01-2. The bobbin receiver 17-1 is closed upon ascertainment of receiving of bobbin 18 by means of the sensor LS 18, and if a signal requiring bobbin-releasing toward a subsequent process is being emitted when the closure of the bobbin receiver 17 is ascertained by the sensor LS 01, the transport-band 01 is actuated and moves at the rate of one pitch. When the bobbin receiver 17-1 is in a closed state containing no bobbin and the sensor LS 05 (not illustrated) ascertains a stock of bobbins at the bobbin stopper 15, bobbin stopper 15 is put into an open state, and a piece of bobbin 18 lying most ahead drops again onto the bobbin receiver 17-1 provided on the lower end of the chute 16-4 through the bobbin chute 16-3 and either one of the changeover devices provided on the left and the right sides of the main bobbin-passage, thus being retained as a stock.

Movement of and control over the transport-band will now be described in detail.

FIGS. 18 through 23 are diagrammatical views illustrating performances and sensing methods regarding cop feeding and other relating operations, with the assumption that n represents the number of spindles on one side of the ring frame, in which throwing of cops 19 from the transport-band to the cop chute 04, i.e., feeding of cops 19 to the subsequent process, and release of bobbins from the bobbin receiver 17-1 to the transport-band 01 are both started at the same time, continued at quite equal paces with each other, and completed at the same time, and feeding of a certain number of cops to be fed to the subsequent process (assumed as 2n here) is detected without judging the presence of a cop, or cops, or counting directly the number thereof. In FIGS. 18 through 23, N-(1), N-(2), . . . N-(n-1), N-(n) represent the serial numbers of spindles of the ring frame 02, 19-(1), 19-(2), . . . 19-(n-1), 19-(n) those of cops corresponding to respective spindles of the ring frame 02, and 18-(1), 18-(2), . . . 18-(n-1), 18-(n) those of bobbins corresponding to respective spindles of the ring frame 02. In other words, the cop No. 19-(n) represents a cop doffed from the spindle No. N-(n) of the ring frame 02, and the bobbin No. 18-(n) represents a bobbin to be applied to the spindle No. N-(n) of the ring frame 02.

The bobbin guide 17-3 which corresponds to the bobbin receiving part is located at a distance from the spindle No.N-(1) at the rate of a half pitch ($1\frac{1}{2}$ p. in the drawing herein, however, any of $2\frac{1}{2}$, $3\frac{1}{2}$, . . . is available), and, since the transport-band 01 moves circuitally and intermittently at the rate of one pitch, a peg 01-2 between the neighboring two 01-2 fed with bobbins 18 is made vacant of bobbin and the center of the vacant peg 01-2 is adapted to agree with the spindle center when the transport-band 01 stops at a fixed position for feeding the vacant peg with bobbin.

Figure 18:
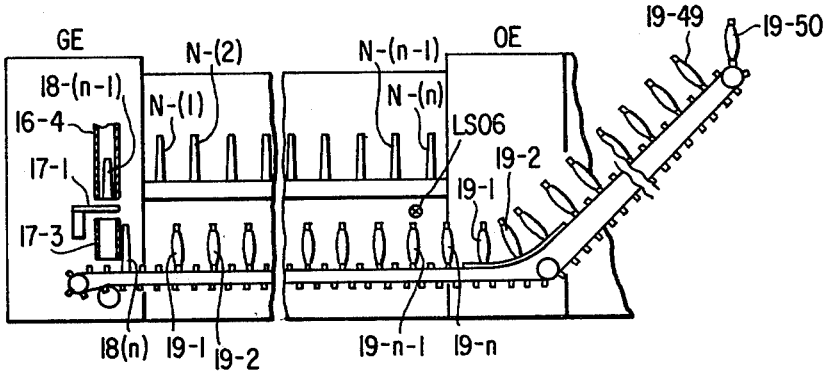
FIGS. 18–23 are diagrammatical views illustrating performances and sensing methods regarding cop feeding and other related operations.
Figure 19:
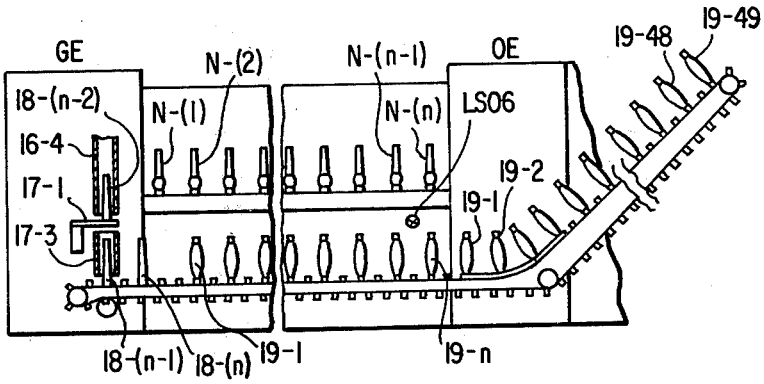
Figure 20:
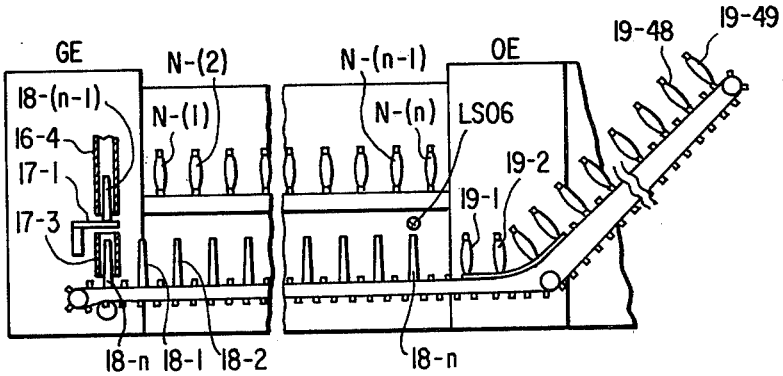

FIG. 18 is a view showing a state that doffing of cops, feeding bobbins 18 to the spindles of the ring frame 02, and preparation for again starting intermittent movement of the transport-band 01 have all been completed. FIG. 18, in which the centers of spindles and those of cops 19 doffed from the ring frame 02 onto the transport-band 01 deviate from each other by the distance of a half pitch, represents a case where the bobbins 18 and cops are both conveyed by a single line transport-band 01, and doffing depends on the automatic doffing apparatus, and things are the same in FIGS. 19 through 23, FIG. 19 illustrates a state wherein the transport-band 01, in the state as shown in FIG. 18, starts movement in response to a signal requiring cop feeding to the subsequent process, the 1st cop 19-(50) is doffed (a cop on the extreme end of OE on the R side of the conveying device 05 in the case of this embodiment) through the cop chute 04, the transport-band is stopped, the bobbin receiver 17-1 is put into an open state upon ascertainment by the sensor LS 03 of the presence of bobbin 18-(n-1) in the bobbin receiver 17-1), bobbin 18-(n-1) is dropped and received by the peg 01-2 of the transport-band 01, the bobbin receiver 17-1 is returned to a closed state upon ascertainment by the sensor LS 18 of the reception of bobbin 18-(n-1); the bobbin 18-(n-2) is received by the bobbin receiver 17-1 upon ascertainment by the sensor LS 01 of the closed state of the bobbin receiver 17-1 after sensing, and is kept as it is for a while until a signal requiring cop feeding to the process is emitted, i.e., until the relay is turned ON. At this time, providing a sensor LS 06 between the spindle No. N-(n-1) and that No. N-(n) to ascertain the presence of the bobbin 18-(n) at the sensor LS 06 every time the transport-band 01 is stopped at a fixed position upon ascertainment by the sensor LS 20, the aforesaid action (feeding cops 19 to the subsequent process and reception of bobbins 18 by the transport-band 01) is repeatedly taken until the presence of the bobbin 18-(n) is detected by the sensor LS 06, after judging that feeding n pieces of cops 19 to the subsequent process has not yet been completed in view of the presence of no bobbin. For example, in this drawing, the bobbin 18-(n) is not present. Subsequent to the state shown in FIG. 3, in which the transport-band that conveys cops and receives bobbins in repetition of the aforesaid action is illustrated, when feeding of n pieces of cops on the R-side to the subsequent process and receiving of bobbins have been completed, another state appears, as shown in FIG. 20, wherein the bobbin 19-(n) reaches the location of the sensor LS 06 and, upon ascertainment of the state thereof and judging that bobbin feeding and cop receiving on the R-side have been completed, two kinds of operation as above on the L-side are started. On the L-side, too, when the sensor LS 07 (not illustrated herein) senses the presence of bobbin 18-(n') (not illustrated herein), the state becomes the same as that in FIG. 20 wherein the transport-band 01 is made prepared for doffing upon judging that feeding of 2n pieces of cops 19 and receiving of 2n pieces of bobbins 18 have been completed, awaiting the next doffing.

Figure 21:
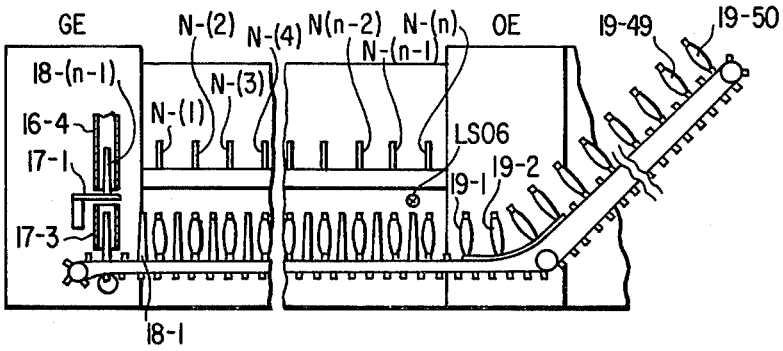

FIG. 21 shows that cops, each containing a fixed length of yarn spun by the ring frame 02, have been doffed by the automatic doffing apparatus and transferred onto pegs 01-2 of the transport-band 01.

Figure 22:
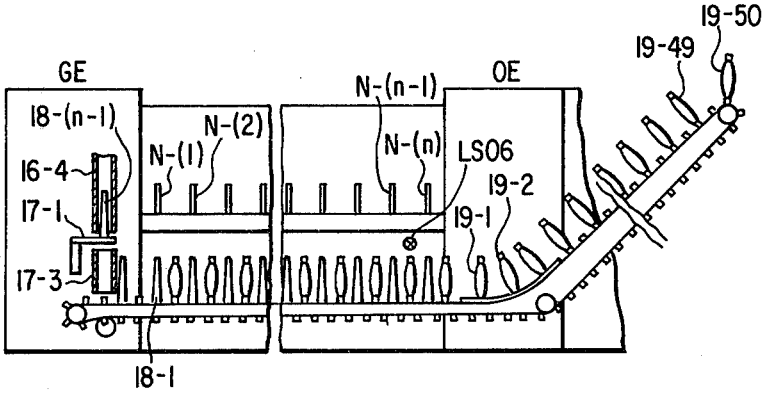
Figure 23:
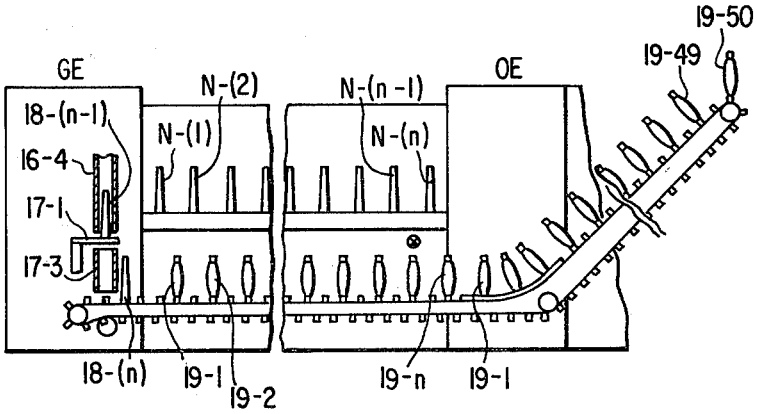

FIG. 22 shows that the transport-band 01 has been moved a distance of a half pitch (the sensor LS 21, not illustrated herein, senses movement of a half pitch) for making the center of bobbin 18 on the transport-band 01 and that of the spindle of the ring frame 02 agree with each other and transferring the bobbin 18 onto the spindle. FIG. 23 shows a state that the bobbins 18 on the transport-band 01 have been transferred to the spindles of the ring frame 02 by means of the automatic doffing apparatus, and this state in FIG. 23 is the same as that in FIG. 18, that is, it is shown that preparation for feeding of cops 19 to the subsequent process has been completed and cop feeding and bobbin receiving are again started in response to a signal demanding cop feeding to the subsequent process.

Figure 28:
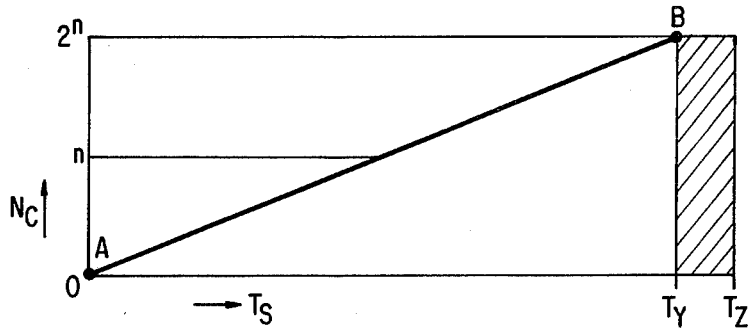
FIG. 28 is a diagram showing the relation between the production of the ring frame and cop-processing time of the winder with respect to the preferred embodiment of the present invention.
Figure 29:
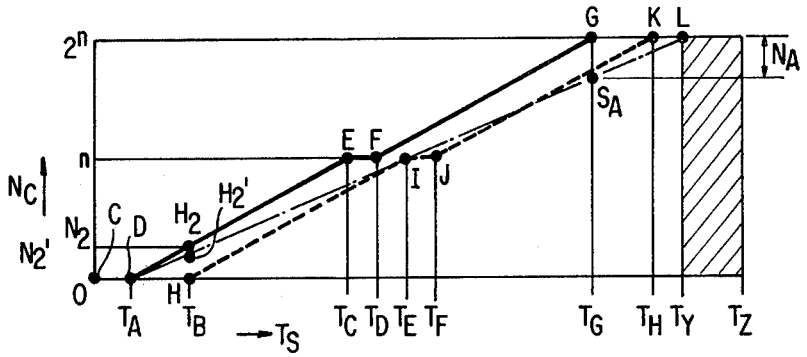
FIG. 29 is a diagram showing a similar relation between the production of the ring frame and cop-processing time of the winder, according to the operation of the transport-band of the conventional apparatus shown in FIG. 26.
Figure 30:
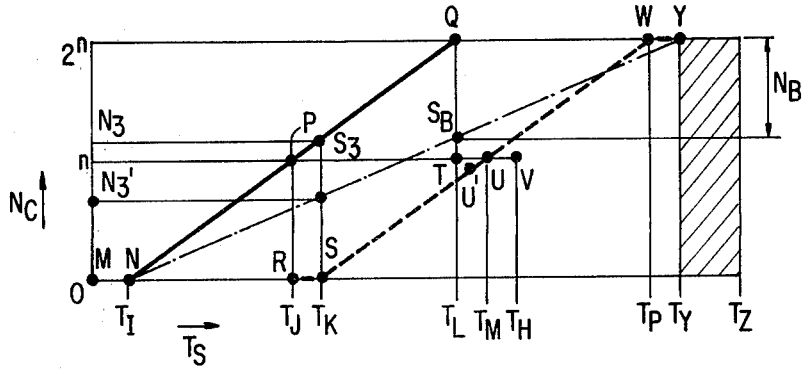
FIG. 30 is a diagram showing the relation between the production of the ring frame and the cop-processing time in the winder, according to the operation of the second conventional system shown in FIG. 27.

Referring now to FIG. 28, taking the number of cops to be fed and that of bobbins to be received (Nc) in the ordinate and time (Ts) in the abscissa, respectively, and assuming A as an initial point where doffing at the ring frame 02 is completed and the transport-band is adapted to be capable of starting moving again, $T_Y$ as the duration in which yarn is being wound by the ring frame 02, i.e., the duration in which the transport-band 01 is allowed to move, and $T_Y$-$T_Z$ (hatched portion in FIG. 28) as the duration in which the transport-band is prevented from freely moving due to the doffing operation and other, the time required for one cycle is $T_Z$. In other words, $T_Y$ is the longest time required for preparing a state in which the next doffing is made possible after completing feeding of cops 19 to the subsequent process by the transport-band 01 and receiving of bobbins 18 by the band 01. A point A represents the time in which doffing is completed and the transport-band 01 is adapted to be capable of starting moving again and a point B represents a time limit before preparation for the next doffing must be completed. Since the cops 19-(1) . . . (50) and 19-(1)'. . . (50)' doffed in the previous operation remain on OE side end of the transport-band 01, as shown in FIG. 18 or 23, between $F_1$, a cop feeding point on the R-side, and $E_1$, a spindle position on the extremity of OE on the R-side, and between $C_1$, a cop feeding point on the L-side, and $B_1$, a spindle position on the extremity of OE on the L-side, feeding of cops 19-(50) on the R-side is started simultaneously with the start of moving of the transport-band 01 and also at the same time receiving of bobbin 18-(n-1) by the transport-band is started. When the cop 19-(1) doffed at a spindle position D on the extremity of GE on the R-side passes a spindle position $E_1$ on the extremity of OE on the R-side, feeding of n pieces of bobbins 18 are completed, and then feeding of bobbin 19-(50)' on the L-side and receiving of bobbin 18-(n-1)' are started. When the cop 19-(1)' doffed at a spindle position $A_1$ on the extremity of GE on the L-side passes a spindle position on the extremity of OE on the L-side, feeding of n pieces of cops 19 and receiving of n pieces of bobbins on the L-side are completed, and at the same time preparation for the next doffing is put into a state of completion. Therefore, regardless of the provision of a stock zone for cops and bobbins, the line of the lowest limit for cop feeding is shown by the continuous line AB in FIG. 28, where n becomes equal to n', namely n=n', and, as a result, the required lowest limit of winding capability of the winder is calculated as $2n/T_Y$ (cops/hour). In conclusion, there is no need for providing stock zones for cops and bobbins as needed in the prior arts, on account of the simultaneous start and completion of cop feeding and bobbin receiving, as well as no need for pre-operation prior to the start of feeding and the restoration of an initial condition subsequent to completion of feeding.

Figure 24:
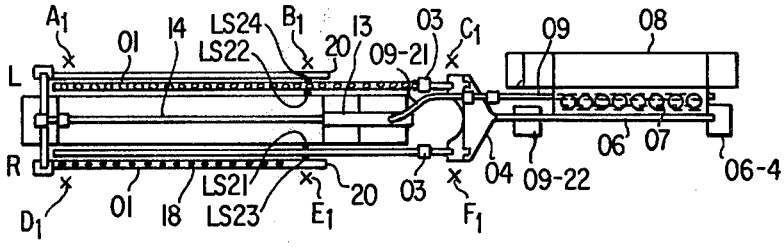
FIG. 24 is a plan view of another embodiment of a transport-band for conveying cops and for receiving bobbins, applied to a ring frame, also according to the present invention.
Figure 26:
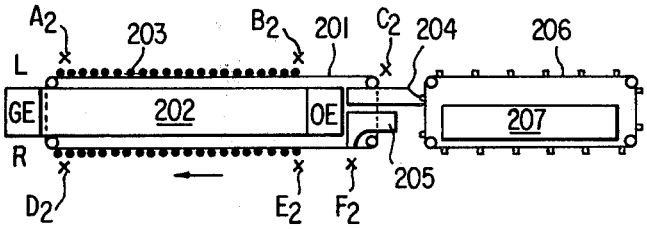
FIG. 26 PRIOR ART
FIG. 26 is a plan view showing an overall arrangement of a conventional apparatus.
Figure 27:
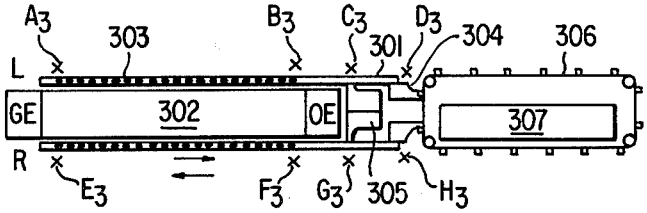
FIG. 27 PRIOR ART
FIG. 27 is plan view showing an overall arrangement of a second conventional apparatus.

In the description hitherto made, an embodiment has been referred to employing a transport-band comprising a single line of belt for conveying cops and receiving bobbins. However, even when the spindle pitch of the ring frame is so small that the joint use of a single belt for mounting cop and bobbins is difficult, this system is available with the application of a slight modification of the control method in such manner as providing, as shown by a plan view in FIG. 24, an exclusive transport-band for conveying cops and that for receiving bobbins in parallel with each other in front of the ring frame, sensors LS 21, LS 22 for ascertaining the presence of cops on the extremities of OEs on the R- and L-sides of the exclusive transport-band for cops, as well as sensors LS 23, LS 24 for ascertaining the presence of bobbins on the extremities of OEs on the R- and L-sides of the exclusive transport-band for bobbins.

In this case, for receiving bobbins by the exclusive bobbin receiving transport-band, a bobbin feeding device, comprising a chute 16-4, a bobbin receiver 17, and a bobbin guide 17-3, is provided apart from the center of the spindle located at the GE side end of the transport-band at a distance equal to N×L (N: positive integer, L: spindle pitch).

Figure 25:
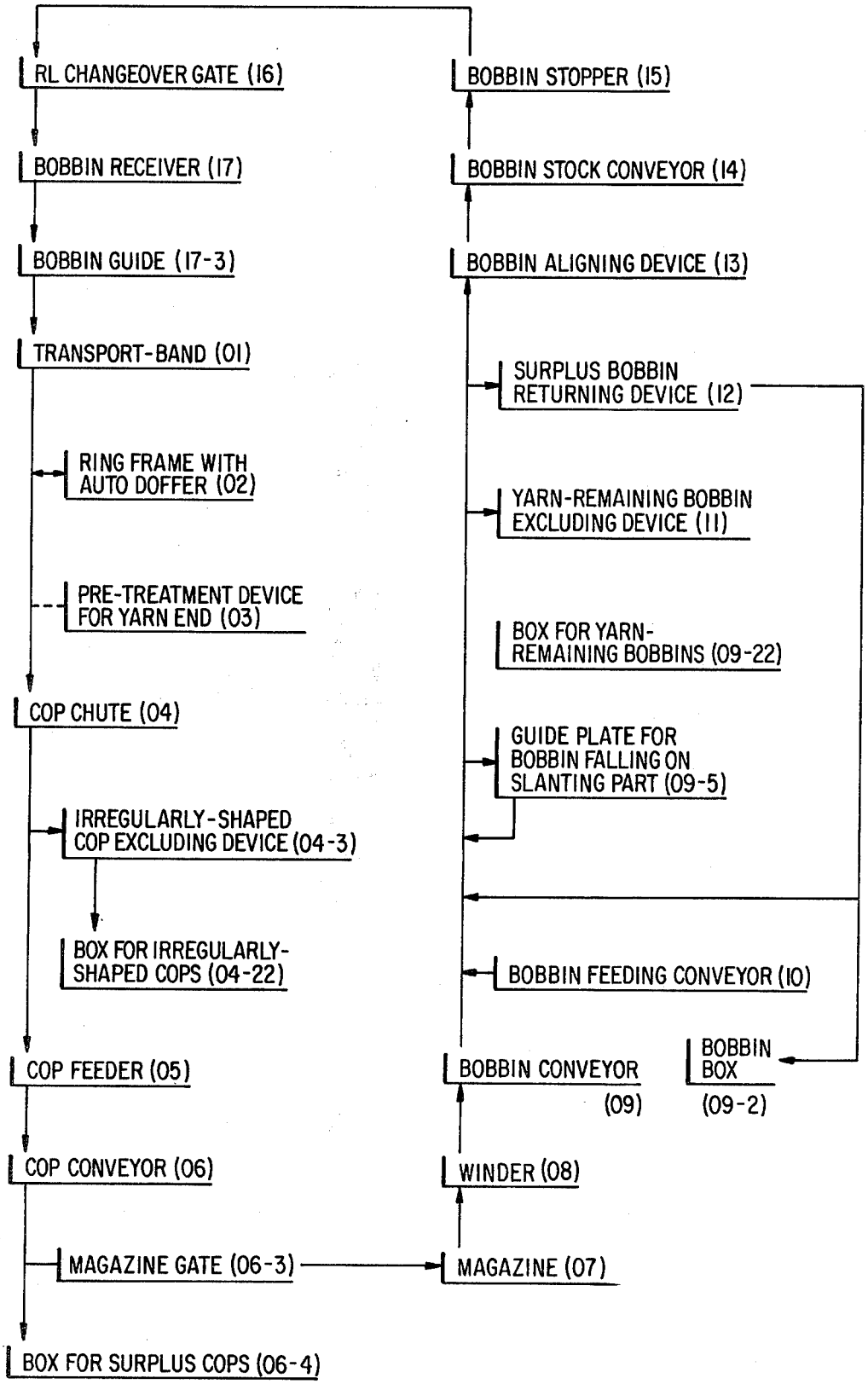
FIG. 25 is a flow chart describing the movement of cops and bobbins in the embodiments according to the present invention.

Flow of cops and bobbins in the embodiment according to this invention is shown in FIG. 25. As hitherto described, conveyance of cops from the ring frame to the winder is characterized in that the transport-band, cop feeding device, and cop conveyor are connected with each other in a simple construction, and return conveyance of bobbins from the winder to the frame is similar to cop conveyance in that the bobbin conveyor, exclusion device for yarn-remaining bobbin, bobbin aligning device, bobbin stock conveyor, and bobbin feeding means are connected with each other.

In the abovesaid embodiment, though the relation between one set of winder and one set of ring frame has been described, when the ratio in the number of ring frames and that of winders is assumed as $N_1$:$N_2$ (both $N_1$ and $N_2$ are arbitrary positive integers), this system is available by additionally providing a bobbin allocation device intersecting the bobbin stock conveyor 14 perpendicularly or at a slant between the bobbin aligning device 13 and the bobbin stock conveyor 14, and a ring-frame-changeover gate, and a cop conveyor intersecting the transport-band 01 perpendicularly or at a slant between the cop chute 04 and cop feeder 05, and the ring-frame-changeover gate.

Also, this system is available without modification even in the case of manual doffing, though the description has been made on the basis of a ring frame equipped with automatic doffing apparatus.

Summarizing three systems, that is, a system according to this invention and the conventional systems (1) and (2) described in the paragraph relating to the prior arts, the following table is obtained:

| System | According to | Conventional System (1) | Conventional System (2) |
|---|---|---|---|
| a | $2n/T_Y$ | $2n/[(T_G - T_D) + (T_C - T_A)]$ | $2n/(T_L - T_I)$ |
| b | $2n/T_Y$ | $2n/(T_Y - T_A)$ | $2n/(T_Y - T_I)$ |
| c | $(0/2n) \times 100$ | $(N_A/2n) \times 100$ | $(N_B/2n) \times 100$ |
| d | $(T_Y/T_Y) \times 100$ | $[[(T_G - T_D) + (T_C - T_A)]/T_Y] \times 100$ | $[(T_L - T_I)/T_Y] \times 100$ |
| e | $(T_Y/T_Y) \times 100$ | $[(T_Y - T_A)/T_Y] \times 100$ | $[(T_Y - T_I)/T_Y] \times 100$ |
| f | $(T_Y/T_Y) \times 100$ | $[T_Y/[(T_G - T_D) + (T_C - T_A)] \times 100$ | $[T_Y/(T_L - T_I)] \times 100$ |
| g | $(T_Y/T_Y) \times 100$ | $[T_Y/(T_Y - T_A)] \times 100$ | $[T_Y/(T_Y - T_I)] \times 100$ |
| h | $(0/2n) \times 100$ | $(N_2'/2n) \times 100$ | $(N_{3'}/2n) \times 100$ |
| i | $(O/2n) \times 100$ | $(N_2/2n) \times 100$ | $(N_3/2n) \times 100$ |

Note:
a: the required lowest limit of the capability of a winder when a stock zone is not provided. (cops/hr)
b: the same when a stock zone is provided. (cops/hr)
c: the minimum ratio of bobbin stocking when a stock zone is provided. (%)
d: operational efficiency of the winder when a stock zone is not provided. (%)
e: the same when a stock zone is provided. (%)
f: ratio between required equipment efficiency of the winder without a stock zone and that according to this invention (assumed as 100%). (%)
g: the same with a stock zone. (%)
h: the minimum stock ratio for bobbins when a stock zone is provided. (%)
i: the same when a stock zone is not provided (%)

The following relations are obtained by putting these systems into practice upon taking the operational condition and others into consideration.

$$(T_G - T_D) + (T_C - T_A) = (0.80 \sim 0.90)T_Y$$

$$(T_Y - T_A) = (0.95 \sim 0.98)T_Y$$

$$(T_L - T_I) = (0.57 \sim 0.62)T_Y$$

$$(T_Y T_I) = (0.95 \sim 0.98)T_Y$$

$N_A=0.4n$ $N_B=0.9n$ $N_2'=0.2n$ $N_2=0.3n$ $N_3'=0.7n$ $N_3=1.2n$

Substituting these values for the above-written table for trial calculations, the result is as follows:

| System | According to this Invention | Conventional system (1) | Conventional system (2) |
|---|---|---|---|
| c | 0 | 20 | 45 |
| d | 100 | 80 ~ 90 | 57 ~ 62 |
| e | 100 | 95 ~ 98 | 95 ~ 98 |
| f | 100 | 111 ~ 125 | 161 ~ 175 |
| g | 100 | 102 ~ 105 | 102 ~ 105 |
| h | 0 | 10 | 35 |
| i | 0 | 15 | 60 |

Reviewing the above results, the following advantages are obtained by employing a system according to this invention:

(1) Labor saving:

Joint control over the ring frame and the winder is made possible, attaining man-less operation between the ring frame and the winder, except for subsidiary works as disposal of yarn breakage, irregularly shaped cops, and yarn-remaining bobbins, making routine works needless thereabout and leading to a great deal of labor saving.

(2) Increase of operational efficiency in winder:

In the prior art (1), operational efficiency of the winder is 95–98% at the maximum when a stock zone is provided and 80–90% when the zone is not provided. In the prior art (2), 95–98% with stock zone, 57–62% without stock zone. Compared with the above, in this system the operational efficiency of the winder can be heightened to the maximum as 100%, enabling synchronous driving of the winder with the ring frame irrespective of provision of a stock zone for cops and bobbins, and requiring no special stock zone for cops and bobbins.

(3) Simplified method of control:

Provision of no stock zone for cops and bobbins as well as reduced frequency of feeding and receiving of cops and bobbins, requiring the least provision of subsidiary equipments, which not only eliminates the needs of control devices thereof but also simplifies the control over the transport-band 01, thanks to a new method in which a signal emitted by the sensor LS 06 provided between the spindles No. N-(n-1) and No. N-(n) is used just at the same time with cop feeding to the subsequent process and bobbin receiving, thus simplifying the control operation to a large extent as compared to the conventional systems (1) and (2).

(4) No disarrangement of yarn and no damage thereto:

Since cops are kept in a stock, subjected to treatment of yarn end, and fed to the cop feeder as they are applied onto the pegs of the transport-band 01, that is, undergo no transference in the course from transport-band to cop feeder, there occurs no disarrangement of yarn end and no damage to cop surface. This is an additional gain of needlessness of a special stock zone.

(5) No trouble in conveying bobbin:

Troubles such as bridge and so on never occur because the substantial function of bobbin stock is given to the transport-band and the bobbin returned from the winder is adjusted in alignment thereof by the bobbin aligning device, due to no provision of a random stock zone in the midway, and conveyed by the bobbin stock conveyor, and dropped onto the transport-band through the bobbin receiver with opening and closing of the bobbin stopper 15.

(6) Function of winder to operate ring frame with 100% efficiency:

The ring frame counter incorporated in the winder and bobbin feeding function can intercept the influence of working efficiency of the winder upon the ring frame.

(7) Minimized occurences of troubles:

Simple construction having smallest number of parts which would be liable to cause troubles.

(8) Ample accessibility in operation:

Not only is the mechanism simple, but also passage can be provided under the transport-band extended between the ring frame and the winder, making patrolling easy for the works, such as taking care of yarn breakage and other troubles.

(9) Possibility of application to arrangement of a plurality of winders to one set of ring frame:

This system is applicable instead of the one-to-one system in the relation between ring frame and winder with a partial modification of the control method, as additional provision of a bobbin allocation conveyor and ring-frame-changeover gate, as well as a cop conveyor and ring-frame-changeover gate.

(10) Easy application to existing equipment:

This system can be used depending on the use of the existing ring frame and winder regardless of the automatic doffing apparatus, and attains automated conveyance of cops and bobbins.

(11) Adaptable to both multi-kind-minor-production system and minor-kind-mass-production:

As this apparatus is a complete closed system, as one unit, it is adaptable to the above-noted two systems.

(12) Low cost of equipment:

No provision of a stock zone for cops and bobbins, no need of countermeasures to trouble, such as the provision of a bridge-breaker to be attached to the zone and control device thereof, and a simple mechanism in the main body minimize the cost of equipment in the case of installation or remodelling, resulting in great enhancement of economical effects.

Obviously numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An apparatus for conveying cops and bobbins for direct connection of a ring frame and a winder comprising:

one line of transport-bands running around in a longitudinal path in front of the ring frame along the spindles of said ring frame;

pegs around the entire outer surface of said transport-band for mounting cops doffed from the ring frame and bobbins to be fed to the ring frame at pitches equal to a half of the spindle pitch;

cop releasing means at one end of an extension in the longitudinal direction of said ring frame and of said transport-band;

bobbin feeding means for feeding bobbins to said transport-band at the other end, opposite to that of said cop releasing means, of said transport-band;

a bobbin guide of said bobbin feeding means located just before said transport-band and being positioned so that a distance equal to $(N+\frac{1}{2})\times L$, (N: zero (0) or positive integer, L: spindle pitch), lies between the center of said guide and that of said spindle; and means for moving said transport-band in one direction intermittently for enabling simultaneous performance of both cop feeding to a subsequent process and bobbin receiving by the transport-band.

2. An apparatus for conveying cops and bobbins for direct connection of the ring frame and the winder according to claim 1, further comprising:

cop feeder means for receiving dropped cops after being released from said transport-band and feeding said cops to the subsequent process;

said bobbin feeding means including a conveyor for feeding bobbins, which have been taken from the winder, in the lengthwise direction one by one;

a yarn-remaining-bobbin excluding device for excluding yarn-remaining-bobbins among bobbins fed by the bobbin conveyor from the conveying line;

a bobbin aligning device for directing end of large diameter of the bobbin toward the front of the moving direction;

a bobbin stock conveyor for receiving bobbins whose large end has been forwardly directed on the belt and conveying said bobbins in line until stopped by the stopper provided on the end thereof;

a bobbin feeding device for receiving bobbins released from said bobbin stock conveyor and guiding said bobbins to the bobbin guide lying just before the transport-band for mounting bobbins.

3. An apparatus for conveying cops and bobbins as set forth in claim 2, wherein the cop feeder is adapted to be actuated and feed cops which are held for the next use to the subsequent process when a computed value is plus (+) as a result of calculation by the ring frame counter or the winder counter.

4. An apparatus for conveying cops and bobbins as set forth in claim 2 wherein a bobbin stock conveyor equipped with a stopper in the shape of a staple (⊓) at the tip thereof is provided above the ring frame.

5. An apparatus for conveying cops and bobbins as set forth in claim 1, wherein said line of said transport-band is provided in front of said ring frame and a sensing device is provided for sensing the presence of bobbin on the transport-band every time said transport-band stops at a fixed position corresponding to the middle point between the centers of a first spindle and a second spindle counted from the side where said cop releasing means is provided.

6. An apparatus for conveying cops and bobbins for direct connection of a ring frame and a winder comprising:

two lines of transport-bands consisting of one exclusively used for mounting cops and the other for bobbins, running around in a longitudinal path in front of the ring frame along the spindles of said ring frame;

pegs around the entire outer surface of one of said lines of said transport-bands for mounting cops doffed from the ring frame at pitches equal to the spindle pitch, and pegs around the entire outer surface of the other of said lines of said transport-bands for mounting bobbins to be fed to the ring frame at the same pitches as the aforesaid spindle pitch;

cop releasing means at one end of an extension in the longitudinal direction of the ring frame and of said one line of said transport-band exclusively used for cop conveying;

bobbin feeding means for feeding bobbins to said other line of said transport-bands exclusively used for bobbin conveying at the other end, opposite to that of said cop releasing means;

a bobbin guide of said bobbin feeding means located just before said transport-band and being positioned so that a distance equal to $N\times L$, (N: positive integer, L: spindle pitch), lies between the center of said guide and that of said spindle; and means for moving said transport-bands in one direction intermittently for enabling simultaneous performance of both cop feeding to a subsequent process and bobbin receiving by said transport-band.

7. An apparatus for conveying two lines of transport-bands according to claim 6, further comprising:

one set of sensing devices for sensing the presence of a cop on the transport-band exclusively used for cops every time said transport-band stops at a fixed position corresponding to the position of the center of the first spindle of the ring frame counted from the side where said cop releasing means is provided; and another set of sensing devices for sensing the presence of a bobbin on the transport-band exclusively used for bobbins every time said transport-band stops at a fixed position corresponding to the position of the center of the first spindle of the ring frame counted from the side opposite to the side where said bobbin feeding means is provided.

* * * * *